US006626491B1

(12) United States Patent
Blome et al.

(10) Patent No.: US 6,626,491 B1
(45) Date of Patent: Sep. 30, 2003

(54) CHAISE LOUNGUE COVER AND TOWEL

(76) Inventors: Robert M. Blome, 1100 Hilton Dr., Richardson, TX (US) 75081; Terry G. McCart, 5909 Legend La., The Colony, TX (US) 75056

( * ) Notice: Subject to any disclaimer, the term of this patent is extended or adjusted under 35 U.S.C. 154(b) by 0 days.

(21) Appl. No.: 10/254,301

(22) Filed: Sep. 25, 2002

(51) Int. Cl.[7] ..... A47C 31/00
(52) U.S. Cl. ..... 297/229; 297/188.2
(58) Field of Search ..... 297/219.1, 229, 297/188.01, 188.2

(56) References Cited

U.S. PATENT DOCUMENTS 3,151,909 A * 10/1964 Gerdetz ..... 297/188.2
4,273,380 A * 6/1981 Silvestri ..... 297/188.06
4,518,198 A * 5/1985 Daniels
4,725,094 A * 2/1988 Greer ..... 297/229
4,877,288 A * 10/1989 Lee ..... 297/229
4,892,353 A * 1/1990 Goddard
5,275,463 A * 1/1994 Rocha ..... 297/229
D359,411 S * 6/1995 Wade ..... D6/610
5,454,643 A * 10/1995 Sullivan
5,618,110 A * 4/1997 Sullivan
5,620,229 A * 4/1997 Ledford ..... 297/229
D382,756 S * 8/1997 Ryan ..... D6/608
5,688,052 A * 11/1997 Compton
D387,939 S * 12/1997 Tedesco et al. ..... D6/610
5,774,912 A * 7/1998 Dominique
5,843,556 A * 12/1998 Levas
D450,970 S * 11/2001 Self
6,460,925 B1 * 10/2002 Kovacs ..... 297/188.04
2001/0035672 A1 * 11/2001 Graft
2002/0063455 A1 * 5/2002 Self

OTHER PUBLICATIONS

Sundays Unlimited; http://www.sundaysunlimited.com/catalog2.htm; Sep. 4, 2002.

* cited by examiner

*Primary Examiner*—Peter R. Brown
(74) *Attorney, Agent, or Firm*—Hitt Gaines, PC

(57) ABSTRACT

The present invention provides, in one embodiment, a chaise longue cover comprising a substantially-rectangular fabric sheet, a chair head pocket, a storage pouch, and an elastic cloth band located proximate an open edge of the chair head pocket wherein the elastic cloth band is configured to form a gather in the open edge. In one embodiment, the substantially-rectangular fabric sheet has opposing head and foot ends, first and second major edges, and front and rear faces. The chair head pocket is formed at the head end and extends from the rear face. The chair head pocket is configured to encase at least a portion of a head of a chaise longue. The storage pouch is coupled to the foot end and has an opening proximate the front face. The storage pouch is configured to receive the fabric sheet and the chair head pocket without inverting the storage pouch. The present invention further provides a method of manufacturing the chaise longue cover.

22 Claims, 4 Drawing Sheets

CHAISE LOUNGUE COVER AND TOWEL

TECHNICAL FIELD OF THE INVENTION

The present invention is directed, in general, to chair covers and, more specifically, to a combination chaise longue cover and beach towel.

BACKGROUND OF THE INVENTION

Full body, outdoor recreational chairs, sometimes called lounge chairs, deck chairs, pool chairs, or the like, may be generally termed chaise longues. They are typically constructed with a wood, plastic or metal tubular frame with the seat, back and leg support areas having a straight or interwoven bands of plastic or fabric for support. Users routinely cover the chaise longue with a beach towel, bath towel, or the like to avoid contact with a hot or soiled surface of the chaise. However, such solutions are less than optimal because the towel soon shifts, the back portion slides down exposing the headrest, or some other portion of the towel exposes a soiled or hot chair surface.

Alternatively, some recreational chairs may accommodate a chair cover specifically designed with fasteners to attach the cover to the chaise longue such as a chair head pocket and elastic cloth bands or straps near the foot to attach the cover to the chair frame. Nevertheless, the cover may become soiled and the user may wish to wash it. Frequently, the chaise longue is provided by the resort or hotel without a cover, and the user needs to bring such a cover with them. In these cases, the user can avoid having to transport a chair, but his/her selected cover must be flexible enough to accommodate a variety of chair designs, for example: with and without armrests. Of course, the user would prefer not to carry a variety of items for his/her day at the beach or pool, but limit such items to those which can perform a variety of functions. Portability and adaptability of the cover to various styles of chairs, in addition to providing an absorptive surface for water or perspiration is clearly to be preferred.

Some beach towel/tote bag combinations have been designed, for example: U.S. Pat. Nos. 5,454,643 and 5,618,110 to William Sullivan. However, the Sullivan beach towel/tote bags require a folding process that finishes with inverting the attached tote bag. The original Sullivan patent does not provide for hands-free carry. The later Sullivan patent calls for attaching shoulder straps with hook and loop fasteners, the intent being to carry the packaged towel as a backpack, thus limiting the mode of carry.

Accordingly, what is needed in the art is a chaise longue cover that provides more utility than a beach towel, is readily transported, and is readily attached to a variety of deck chairs.

SUMMARY OF THE INVENTION

To address the above-discussed deficiencies of the prior art, the present invention provides, in one embodiment, a chaise longue cover comprising a substantially-rectangular fabric sheet, a chair head pocket, a storage pouch, and an elastic cloth band located proximate an open edge of the chair head pocket wherein the elastic cloth band is configured to form a gather in the open edge. In one embodiment, the substantially-rectangular fabric sheet has opposing head and foot ends, first and second major edges, and front and rear faces. The chair head pocket is formed at the head end and extends from the rear face. The chair head pocket is configured to encase at least a portion of a head of a chaise longue. The storage pouch is coupled to the foot end and has an opening proximate the front face. The storage pouch is configured to receive the fabric sheet and the chair head pocket without inverting the storage pouch. The present invention further provides a method of manufacturing the chaise longue cover.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1B:
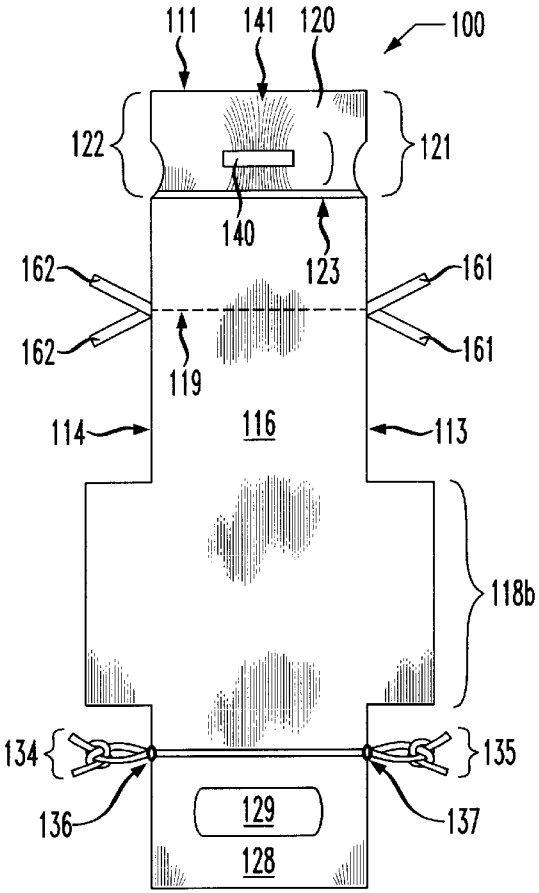
FIG. 1B illustrates a rear surface view of the chaise longue cover and towel of FIG. 1.
Figure 1A:
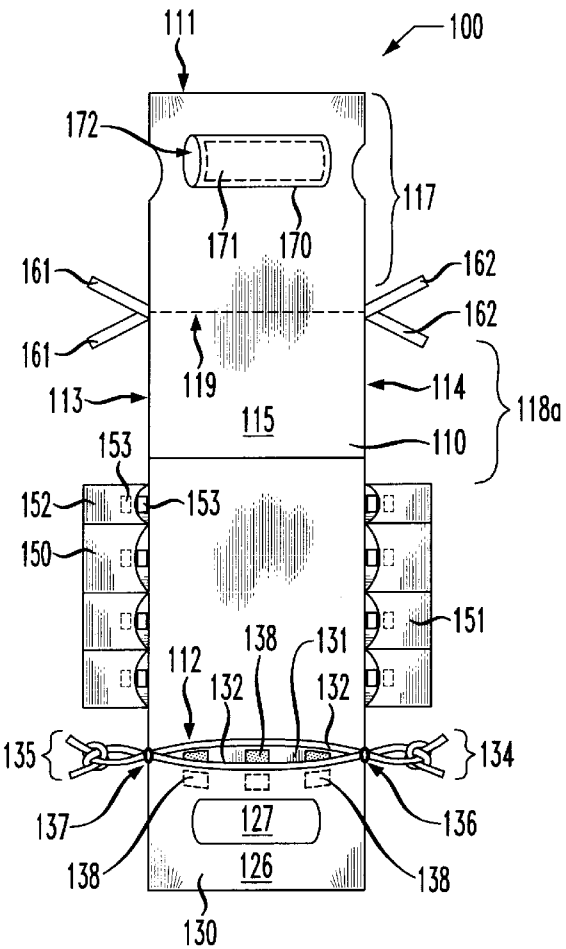
FIG. 1A illustrates a front surface view of one embodiment of a chaise longue cover and towel constructed according to the principles of the present invention.

Refer now simultaneously to FIGS. 1A and 1B. FIG. 1A illustrates a front surface view of one embodiment of a chaise longue cover and towel 100 constructed according to the principles of the present invention. FIG. 1A illustrates a rear surface view of the chaise longue cover and towel of FIG. 1A. In one embodiment, the chaise longue cover 100 comprises a substantially-rectangular fabric sheet 110, a chair head pocket 120, a storage pouch 130, an elastic cloth band 140, and at least one side pocket 150. The fabric sheet 110 has head and foot ends 111, 112, respectively; first and second major edges 113, 114, respectively; and front and rear faces 115, 116, respectively. In a preferred embodiment, the fabric sheet 110 comprises terry cloth or other similar fabric that is suitable to use as a towel.

The chair head pocket 120 is formed at the head end 111 and extends from the rear face 116. In a preferred embodiment, the chair head pocket 120 is formed by turning an extended portion of the fabric sheet 110 over upon the rear face 116, and stitching edges 121, 122 together, leaving an open edge 123. The elastic cloth band 140 is located proximate the open edge 123 and is configured to form a gather 141 in the open edge 123.

The storage pouch 130 is coupled to the foot end 112 and has an opening 131 proximate the front face 115. In one embodiment, the storage pouch 130 may be formed of a separate piece of fabric of generally the same type as the substantially-rectangular fabric sheet 110. The storage pouch 130 has a casing 132 formed about an edge 133 of the storage pouch 130. A drawstring 134 is located within the casing 132 to assist in closing the opening 131. In one embodiment, the drawstring 134 comprises two drawstrings 134, 135 exiting opposite corners 136, 137 of the storage pouch 130. One who is skilled in the art will readily understand the operation of one or two drawstrings. The storage pouch 130, after thus being assembled, may then be coupled, with the casing 132 proximate the foot end 112, to the substantially-rectangular fabric sheet 110. One who is skilled in the art will recognize that a variety of types of stitching, or other appropriate forms of coupling in the fabric arts, as well as other methods of forming the storage pouch 130 may be used.

In one embodiment, the storage pouch 130 comprises a front face 126 whereupon is a first logotype 127. The first logotype 127 may suitably be that of a sponsor, e.g., a hotel or a tanning product. The tanning product company may therefore opportunely advertise with the first logotype 127 for view by passersby, while also including a sample thereof within one of the side pockets 150 as a gift for the owner. The placement of the first logotype 127 on the front face 126 of the storage pouch 130 advantageously allows the first logotype 127 to be visible when a person is using the chaise longue cover and towel 100 on various chaise longues. In one embodiment, the storage pouch 130 further comprises a rear face 128 whereupon is a second logotype 129. Thus, a second advertiser may affix their advertisement as the second logotype 129. The first and second logotypes 127, 129 may be imprinted using impregnated dye, plastisol, or silk screening.

The storage pouch 130 is configured to receive the fabric sheet 110 and the chair head pocket 120 without inverting the storage pouch 130. That is, the fabric sheet 110 with chair head pocket 120 may be folded or rolled, whichever is more convenient for the user, and inserted into the storage pouch 130. In one embodiment, the fabric sheet 110 may be stowed into the storage pouch 130 without inverting the fabric sheet 110. That is, the chair head pocket 120 is removed from a chair frame, the side pockets 150, 151 flipped onto the front face 115, and with the fabric sheet remaining on the chair, the fabric sheet 110 is then folded or rolled toward the foot end 112. The rolled or folded fabric sheet 110 is then inserted into the storage pouch 130 and the storage pouch 130 drawn shut. That is, the two drawstrings 134, 135 may be pulled from their respective corners 136, 137 to cinch the storage pouch 130 closed. In one embodiment, the storage pouch 130 further comprises an alternate storage pouch closure 138 located proximate the opening 131. In a preferred embodiment, the alternate storage pouch closure 138 comprises hook and loop fasteners and may comprise multiple sections. Thus, the storage pouch 130 may be closed using the alternate storage pouch closure 138 to protect the pocket contents when the chaise longue cover 100 is in use on a chair without using the drawstrings 134, 135.

The fabric sheet 110 has a back portion 117 located proximate the head end 111, a seat portion 118*a* proximate the back portion 117, and a leg portion 118*b* proximate the foot end 112. In one embodiment, the chaise longue cover and towel 100 may include a first and second securing tabs 161, 162 that provide an additional mechanism for securing the chaise longue cover and towel 100 to a variety of chaise longues. The first securing tab 161 is coupled to the first major edge 113 proximate a junction 119 of the back portion 117 and the seat portion 118*a*. The second securing tab 162 is coupled to the second major edge 114 proximate the junction 119. In another embodiment, chaise longue cover and towel 100 includes a pillow pocket 170 that is coupled to the front face 115 proximate the head end 111 so as to accept a pillow 171 or a rolled/folded towel to provide the user with a pillow for his/her head. The pillow pocket 170 has an opening 172 for insertion and removal of the pillow 171. In yet another embodiment, the pillow pocket 170 may have an opening at each end, similar to the opening 172, to allow the insertion and extraction of the pillow 171 or the rolled/folded towel from either end of the pillow pocket 170.

In one embodiment, the at least one side pocket 150 is coupled to the first major edge 113 or the second major edge 114. In a preferred embodiment, the chaise longue cover 100 comprises a plurality of side pockets 150, 151. The plurality of side pockets 150, 151 may be coupled to either or both of the first major edge 113 or the second major edge 114. In one embodiment, at least one side pocket 152 comprises a side pocket closure 153. In one embodiment, the side pocket closure 153 comprises hook and loop fasteners that cooperate to close the side pocket 152. Such a side pocket 152 may be conveniently used to retain products related to the use of the chaise longue cover and towel 100 such as: tanning lotions or oils, sunglasses, books, etc. The side pockets 150–152 may be lined with a non-porous surface, such as plastic or vinyl, to prevent tanning lotions or oils from staining the outer fabric material. Such closeable side pockets as hereinabove described are especially suited for retaining manufacturer's samples of such tanning lotions or other such products that a manufacturer may wish to introduce to an end user, purchaser, or prospective customer. In order to store the chaise longue cover 100 in the storage pouch 130, the side pockets 151, 152 need only be flipped onto the front face 115 of the fabric sheet 110. The fabric sheet 110 is then rolled or folded to a size convenient to place into the storage pouch 130.

Figure 2A:
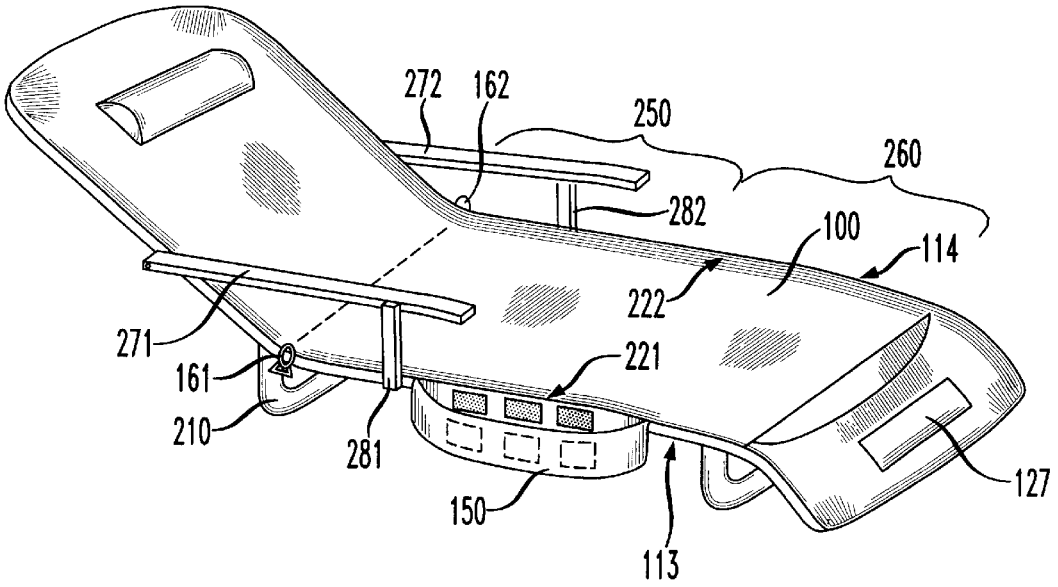
FIG. 2A illustrates a front perspective view of the chaise longue cover of FIGS. 1A and 1B installed on a chaise longue.
Figure 2B:
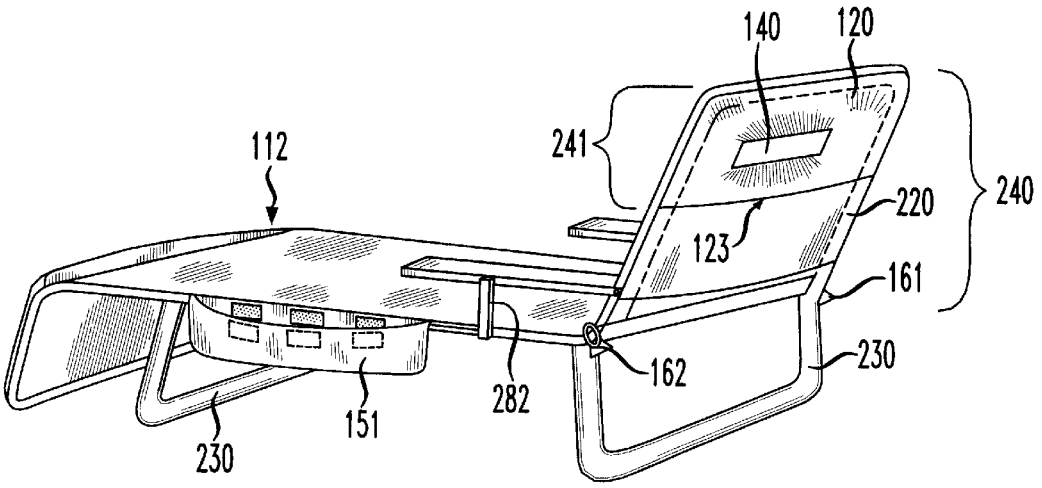
FIG. 2B illustrates a rear perspective view of the chaise longue and chaise longue cover of FIG. 2A.

Refer now simultaneously to FIGS. 2A and 2B. FIG. 2A illustrates a front perspective view of the chaise longue cover 100 of FIGS. 1A and 1B installed on a chaise longue 210. FIG. 2B illustrates a rear perspective view of the chaise longue 210 and chaise longue cover 100 of FIG. 2A. The chaise longue 210 comprises a frame 220, legs 230, a chair back 240, a chair seat 250, a lower leg portion 260, right and left armrests 271, 272, and right and left armrest supports 281, 282. The chair head pocket 120 can be seen to encase at least a portion 241 of a head of the chair back 240. The side pockets 150, 151 are positioned between the right or left armrest supports 281, 282 and the foot end 112. Thus, the side pockets 150, 151 are positioned in such a way that they are forward of and will not interfere with the right and left armrest supports 281, 282. While the side pockets 150, 151 are shown coupled to both the first and second major edges 113, 114, one who is skilled in the art will understand that, in an alternative embodiment, side pockets may only be present on one side. As is shown in FIGS. 2A and 2B, side pocket(s) 150 may be a single pocket on either or both sides. Additionally, these single pockets 150 may have multiple hook and pile closures as described with relation to FIGS. 1A and 1B. The first logotype 127 is visible for all passersby to see in this deployed configuration of the chaise longue cover 100.

In the illustrated embodiment, the first and second securing tabs 161, 162, respectively, are configured to couple the first and second major edges 113, 114, respectively, to first and second side rails 221, 222, respectively, of the chaise longue 210. If the side rails 221, 222 are not accessible, the first and second securing tabs 161, 162 may be coupled to one of the legs 230 of the chaise longue 210. In alternative embodiments, the first and second securing tabs 161, 162 may comprise hook and pile fasteners or conventional snap fasteners. The first and second securing tabs 161, 162 therefore restrain the first and second major edges 113, 114 so that the chaise longue cover 100 remains appropriately positioned on the chaise longue 210 and prevents exposure of a soiled or hot portion of the chaise longue 210. The elastic cloth band 140 is located proximate the open edge 123 of the chair head pocket 120, but does not extend for a full width of the fabric sheet 110. The elastic cloth band 140 thereby takes up any slack in the chair head pocket 120 along the open edge 123.

Figure 3A:
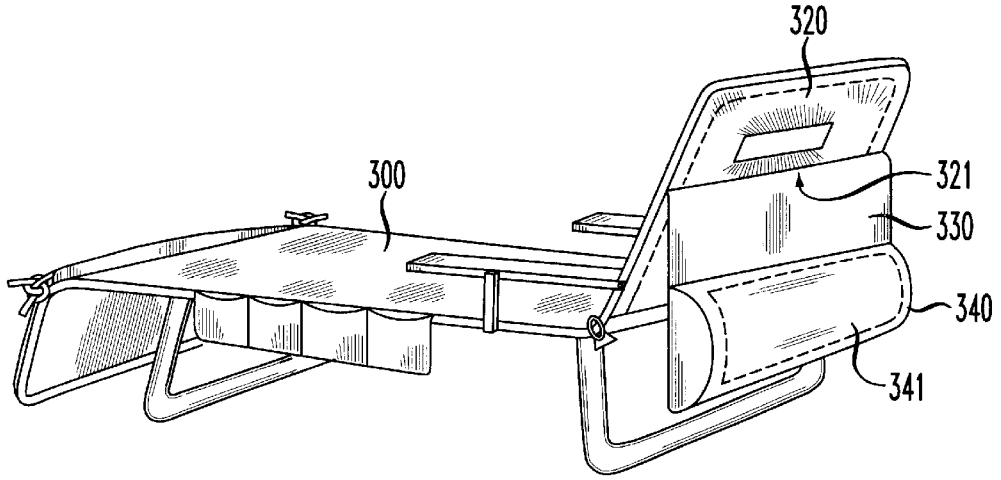
FIG. 3A illustrates a rear perspective view an alternative embodiment of the chaise longue cover of FIGS. 1A and 1B installed on a chaise longue.
Figure 3B:
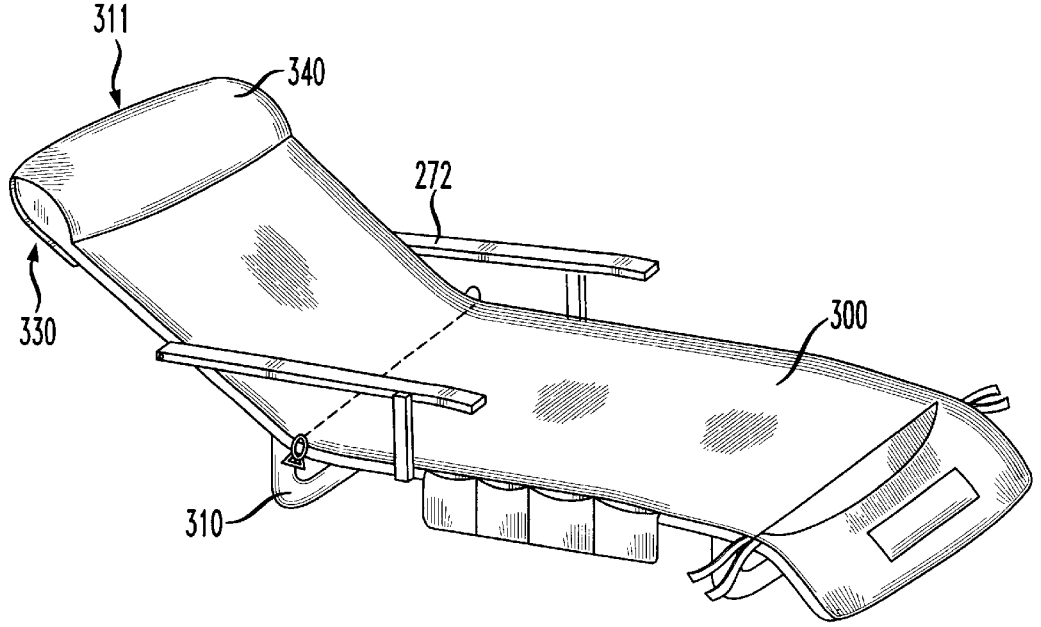
FIG. 3B illustrates a front perspective view of the chaise longue and chaise longue cover of FIG. 3A.

Refer now to FIGS 3A and 3B. FIG. 3A illustrates a rear perspective view an alternative embodiment 300 of the chaise longue cover of FIGS. 1A and 1B with a pillow pouch 340 installed on a chaise longue 310. FIG. 3B illustrates a front perspective view of the chaise longue 310 and chaise longue cover 300 of FIG. 3A with the pillow pouch 340 in its use position. Best seen in FIG. 3A, the chaise longue cover 300 comprises a chair head pocket 320 having an edge 321, a foldback panel 330, and the pillow pouch 340. The foldback panel 330 extends from the edge 321 and attaches the pillow pouch 340 to the chair head pocket 320. As can be seen in FIG. 3B, the pillow pouch 340 is foldable back over the chair head pocket 320 to place the pillow pouch 340 in a location on the face of the chaise longue cover 300 near its head end 311. The pillow pouch 340 is configured to receive a pillow 341 or a towel to cushion the head of a user reclined upon the chaise longue 310. In a related embodiment, the pillow pouch 340 may include a pillow pouch closure (not shown) similar to the storage pouch closure 138 of FIG. 1A.

Figure 4A:
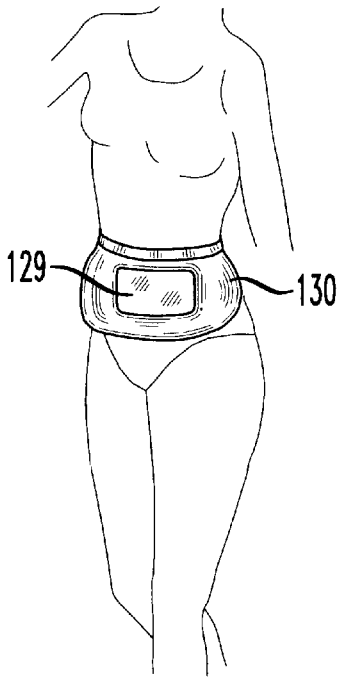
FIG. 4A illustrates that the drawstrings may be used as a rope belt about the waist of the user for hands-free carry with the storage pouch carried at the front of the user.
Figure 4B:
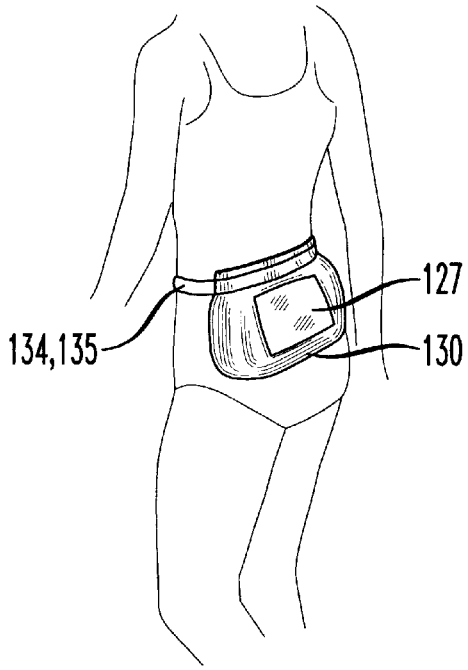
FIG. 4B illustrates that the drawstrings may likewise be used as a rope belt for hands-free carry with the storage pouch carried at the back of the user.
Figure 4C:
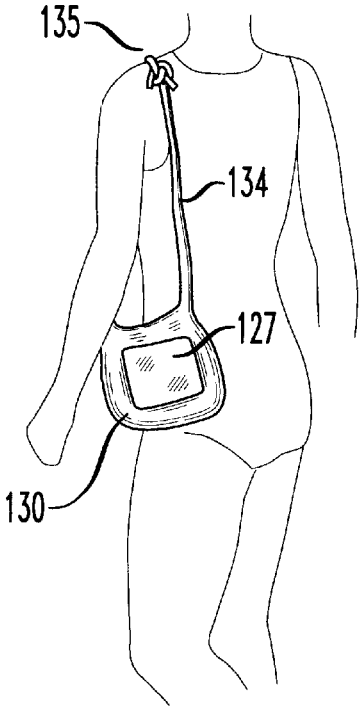
FIG. 4C illustrates that the drawstrings may be used as a shoulder strap for carrying the storage pouch.
Figure 4D:
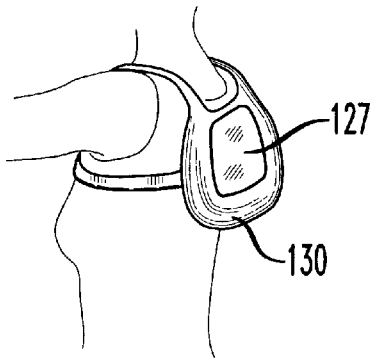
FIG. 4D illustrates the storage pouch carried as a back pack.

Referring now to FIG. 4A through 4D, illustrated are alternative methods of carry for the chaise longue cover 100 of FIGS. 1A and 1B. FIG. 4A illustrates that the drawstrings 134, 135 may be used as a rope belt about the waist of the user for hands-free carry with the storage pouch 130 carried at the front of the user. FIG. 4B illustrates that the drawstrings 134, 135 may likewise be used as a rope belt for hands-free carry with the storage pouch 130 carried at the back of the user. Alternatively, as shown in FIG. 4C, the drawstrings 134, 135 may be used as a shoulder strap for carrying the storage pouch 130. FIG. 4D illustrates the storage pouch carried as a back pack. In any of the configurations of FIGS. 4A, 4B, 4C or 4D, either the first logotype 127 or the second logotype (not shown) is always visible to promote advertising of the logotype owner.

Thus, a chaise longue cover and towel combination has been described that enables a user to securely fasten the cover to a chaise lounge while also providing at least four convenient methods of carrying. The chaise longue cover also includes side pockets for holding samples of related products and alternative methods of forming a stuffable pillow pocket for the user's head. The configuration of the storage pouch combined with the chaise longue cover assures that an advertisers logo is always visible.

Although the present invention has been described in detail, those skilled in the art should understand that they can make various changes, substitutions and alterations herein without departing from the spirit and scope of the invention in its broadest form.

What is claimed is:

1. A chaise longue cover, comprising:

a substantially-rectangular fabric sheet having head and foot ends, first and second major edges, and front and rear faces;

a chair head pocket formed at said head end and extending from said rear face, said chair head pocket configured to encase at least a portion of a head of a chaise longue;

a storage pouch coupled to said foot end and having an opening proximate said front face, said storage pouch configured to receive said fabric sheet and said chair head pocket without inverting said storage pouch; and an elastic cloth band located proximate an open edge of said chair head pocket and configured to form a gather in said open edge.

2. The chaise longue cover as recited in claim 1 further comprising:

a casing formed proximate said foot end and about an edge of said storage pouch; and a drawstring located in said casing.

3. The chaise longue cover as recited in claim 1 further comprising at least one side pocket coupled to said first major edge or said second major edge.

4. The chaise longue cover as recited in claim 3 wherein said at least one side pocket is adapted to be coupled to said first major edge or said second major edge between first or second armrest supports of the chaise longue and said foot end.

5. The chaise longue cover as recited in claim 3 wherein said at least one side pocket comprises a side pocket closure.

6. The chaise longue cover as recited in claim 1 wherein said fabric sheet has a back portion proximate said head end and a seat portion proximate said back portion and further comprising:

a first securing tab coupled to said first major edge proximate a junction of said back portion and said seat portion; and a second securing tab coupled to said second major edge proximate said junction, said first and second securing tabs configured to couple said first and second major edges, respectively, to first and second side rails of said chaise longue.

7. The chaise longue cover as recited in claim 1 further comprising:

a foldback panel extending from an edge of said chair head pocket; and a pillow pouch extending from said foldback panel, said pillow pouch configured to receive a pillow or a towel.

8. The chaise longue cover as recited in claim 1 further comprising a pillow pocket coupled to said front face proximate said head end and configured to receive a pillow or a towel.

9. The chaise longue cover as recited in claim 1 wherein said storage pouch has a front surface and further comprising a first logotype affixed said front surface.

10. The chaise longue cover as recited in claim 1 wherein said storage pouch has a rear surface and further comprising a second logotype affixed said rear surface.

11. The chaise longue cover as recited in claim 1 further comprising a storage pouch closure located proximate said opening.

12. A method of manufacturing a chaise longue cover, comprising:

forming a substantially-rectangular fabric sheet having head and foot ends, first and second major edges, and front and rear faces;

forming a chair head pocket at said head end and extending from said rear face, said chair head pocket configured to encase at least a portion of a head of a chaise longue;

coupling a storage pouch to said foot end, said storage pouch having an opening proximate said front face, said storage pouch configured to receive said fabric sheet and said chair head pocket without inverting said storage pouch; and coupling an elastic cloth band proximate an open edge of said chair head pocket, said elastic cloth band configured to form a gather in said open edge.

13. The method as recited in claim 12 further comprising:

forming a casing proximate said foot end and about an edge of said storage pouch; and locating a drawstring in said casing.

14. The method as recited in claim 12 further comprising coupling at least one side pocket to said first major edge or said second major edge.

15. The method as recited in claim 14 wherein coupling at least one side pocket includes configuring the at least one side pocket to be coupled between first or second armrest supports of the chaise longue and said foot end.

16. The method as recited in claim 14 wherein coupling at least one side pocket includes coupling at least one side pocket comprising a side pocket closure.

17. The method as recited in claim 12 wherein said fabric sheet has a back portion proximate said head end and a seat portion proximate said back portion and further comprising:

coupling a first securing tab to said first major edge proximate a junction of said back portion and said seat portion; and coupling a second securing tab to said second major edge proximate said junction, said first and second securing tabs configured to couple said first and second major edges, respectively, to first and second side rails of said chaise longue.

18. The method as recited in claim 12 further comprising:

extending a foldback panel from an edge of said chair head pocket; and extending a pillow pouch from said foldback panel, said pillow pouch configured to receive a pillow or a towel.

19. The method as recited in claim 12 further comprising coupling a pillow pocket to said front face proximate said head end, said pillow pocket configured to receive a pillow or a towel.

20. The method as recited in claim 12 wherein said storage pouch has a front surface and further comprising affixing a first logotype to said front surface.

21. The method as recited in claim 12 wherein said storage pouch has a rear surface and further comprising affixing a second logotype said rear surface.

22. The method as recited in claim 12 further comprising locating a storage pouch closure proximate said opening.

* * * * *